US007059413B2

(12) United States Patent
Abramov et al.

(10) Patent No.: US 7,059,413 B2
(45) Date of Patent: Jun. 13, 2006

(54) METHOD FOR INTENSIFICATION OF HIGH-VISCOSITY OIL PRODUCTION AND APPARATUS FOR ITS IMPLEMENTATION

(75) Inventors: Oleg Abramov, Moscow (RU); Vladimir Abramov, Moscow (RU); Andrey Pechkov, Moscow (RU); Alfredo Zolezzi Garreton, Viña del Mar (CL); Luis Paredes-Rojas, Viña del Mar (CL)

(73) Assignee: Klamath Falls, Inc., Tortola (VG)

( * ) Notice: Subject to any disclaimer, the term of this patent is extended or adjusted under 35 U.S.C. 154(b) by 129 days.

(21) Appl. No.: 10/805,117

(22) Filed: Mar. 19, 2004

(65) Prior Publication Data

US 2005/0205254 A1 Sep. 22, 2005

(51) Int. Cl.
*E21B 43/24* (2006.01)

(52) U.S. Cl. ..... 166/302; 166/60; 166/177.2; 166/369

(58) Field of Classification Search ..... None
See application file for complete search history.

(56) References Cited

U.S. PATENT DOCUMENTS 4,558,737 A * 12/1985 Kuznetsov et al. ..... 166/60

* cited by examiner

*Primary Examiner*—Zakiya W. Bates
(74) *Attorney, Agent, or Firm*—The Hecker Law Group, PLC

(57) ABSTRACT

In the oil-producing industry, an apparatus can be used to increase the yield of oil wells developed by conventional methods during production of high viscosity oils. Use of the apparatus results in an increase in the permeability of a reservoir and a reduction in the viscosity of oil, added to an increase in environmental safety by avoiding use of chemical reagents and steam generators. The apparatus applies a high power ultrasonic field in the well bottom zone that reduces viscosity of oil, also heating the well bottom zone. The apparatus comprises a surface ultrasonic generator and at least one ultrasonic magnetostrictive radiator placed at the end of oil well tubing, using high frequency currents that warm the tubing and maintain the viscosity of oil during transport to the surface.

13 Claims, 4 Drawing Sheets

METHOD FOR INTENSIFICATION OF HIGH-VISCOSITY OIL PRODUCTION AND APPARATUS FOR ITS IMPLEMENTATION

FIELD OF APPLICATION

The invention applies to the oil-producing industry and is intended for the intensification of the processes of increasing the yield of oil wells used for the production of high-viscosity oils.

BACKGROUND OF THE INVENTION

At present, a fairly large number of methods and apparatuses are known that allow enhancement of production processes for high-viscosity oils. In most cases, these techniques employ physicochemical methods of influence on a stratum (well bottom zone) and on transport systems that transport oil from the stratum to the surface. In particular, it is proposed to add different reagents into a well and to influence strata by elastic vibrations of different frequency, shock waves, magnetic and electric fields or combinations thereof. In some cases, the use of devices that include sources of elastic vibrations and systems of induction heating are provided.

A method for intensification of oil production by the excitation of elastic vibrations in a stratum and the well bottom zone is known (U.S. Pat. No. 5,950,726 A, published on Jan. 31, 1991). Elastic vibrations are excited by use of a hydraulic vibration generator, by a cyclic change of pressure in liquid being supplied. The excitation of elastic vibrations leads to a decrease in the viscosity of oil, a rise in the permeability of a reservoir and an increase in the output of a well.

The disadvantage of this method is that it does not provide for the effects on oil during its transport by oil-well tubing, thus decreasing the efficiency of the method.

A prototype of the first object of the proposed invention is a method for development of oil pool (RU 2184842 C2, published on Jul. 10, 2002), where stimulation of producing formation with a heat source and source of elastic vibrations is proposed. A heat source is placed inside an injection well. Treatment with the heat source is carried out with periodic variation of its power. A source of elastic vibrations is installed on the surface of the wellhead of the oil producing well. Heat source and source of clastic vibrations operate at the same frequency and periodically constant difference of phases. The effect obtained is the most complete withdrawal of oil due to varying of oil viscosity and phase permeability of reservoir for oil and water.

The disadvantage of the method is its insufficient efficiency because it does not provide for the effect on oil during its transport by oil well tubing.

A device for the production of high-viscosity oils is known (RU 2198284 C2, published on Feb. 10, 2003) that involves the use of an induction well electric heater. In this device, oil-well tubing (OWT) fitted with metal rings with slits, is a casing and at the same time a magnetic core. Wires of an induction coil wound on the external surface of the casing are laid through slits. The use of the device allows heating of the oil being extracted due to the conversion of electrical energy into thermal energy.

The disadvantage of this device is that it does not provide for the additional effect on the stratum and oil in the well bottom zone, decreasing the efficiency of the device.

A prototype of the second object of the proposed invention is a thermo-acoustic well apparatus (SU 1086131 A, published on Apr. 15, 1984) that allows conducting the simultaneous heating and irradiation of oil stratum in the well bottom zone with ultrasound using a magnetostrictive radiator, which increases the inflow of oil into a well.

The disadvantage of the device is that the treatment is carried out only in the oil stratum without the heating of OWT, which decreases the efficiency of the device during oil production.

Acoustic Well Recovery Method and Device Patent Application U.S. Ser. No. 10/615,230, proposes a method for acoustic stimulation and the devices for its implementation, characterized because it comprises an electric generator and a vibratory system placed inside the well. The method proposed in patent application, U.S. Ser. No. 10/615,230, promotes the formation of shear vibrations in the extraction zone. The disadvantage of said Application in relation to the production of high viscosity fluids lies in the fact that it does not consider neither the heat generated in the extraction zone or the stimulation of recovered fluids during transport to the surface through the oil well tubing.

SUMMARY

In the first and second objects of the invention, a technical result is achieved that lies in increasing the efficiency of production of high-viscosity oils during the development of wells by conventional methods used in the oil industry owing to a rise in the permeability of a reservoir and a reduction in the viscosity of oil and in increasing environmental safety owing to the absence of chemically active reagents (acids) and steam generators.

In the first object of the invention—a method for intensification of high-viscosity oil production, the specified technical result is achieved in the following way.

In the method of intensification of production of high-viscosity oils, the viscosity of oil in the well bottom zone is decreased by the effect of a high-power ultrasonic field on it. The excited ultrasonic field provides in addition the heating of the well bottom zone. The achieved viscosity of oil is maintained during its transport to the daylight through the heating of oil-well tubing (OWT) by high-frequency currents.

In the second object of the invention—an apparatus for intensification of high-viscosity oil production, the specified technical result is achieved in the following way.

An apparatus for intensification of production of high-viscosity oils contains the unit of ultrasonic excitation of the well bottom zone which includes a surface ultrasonic generator and at least one ultrasonic magnetostrictive radiator placed at the end of oil-well tubing (OWT) insulated electrically from the casing pipe of a well, which are electrically connected with each other by two cords of a three-cord electrical cable. The heating unit of the OWT consists of a daylight surface high-frequency generator and an OWT heating line, which is distributed along the entire length of OWT and heats by high-frequency currents, including the third cord of the three-cord electrical cable.

In one of the cases of the invention implementation, the daylight surface high-frequency generator of the OWT heating unit is electrically connected by a grounded wire to OWT. OWT is electrically insulated from the casing pipe of a well. At the location of the ultrasonic radiator, the surface high-frequency generator is connected to OWT by the third cord of the three-cord electrical cable.

In the other case of the invention implementation, one output of the daylight surface high-frequency generator of the OWT heating unit is connected to one of the outputs of the surface ultrasonic generator, and the cord of the three-cord electrical cable which is connected to this output is a common cord for both generators. At that, the second output of the surface daylight high-frequency generator is connected by the third cord of the three-cord electrical cable at the place of the location of the ultrasonic magnetostrictive radiator to the common cord of the three-cord electrical cable.

Besides, the OWT heating line, by high-frequency currents, contains in addition at least two inductors placed on the OWT and connected to the third cord of the three-cord electrical cable.

At that, an ultrasonic magnetostrictive radiator is made in the form of a hollow cylinder, whose inside diameter matches the OWT inside diameter.

DETAILED DESCRIPTION OF INVENTION

The invention is illustrated in FIGS. 1–4, by a schematic drawing in which an apparatus for the implementation of the method for intensification of production of high-viscosity oils with different cases for the connection of the heating line of the OWT heating unit by high-frequency currents is presented.

Figure 1:
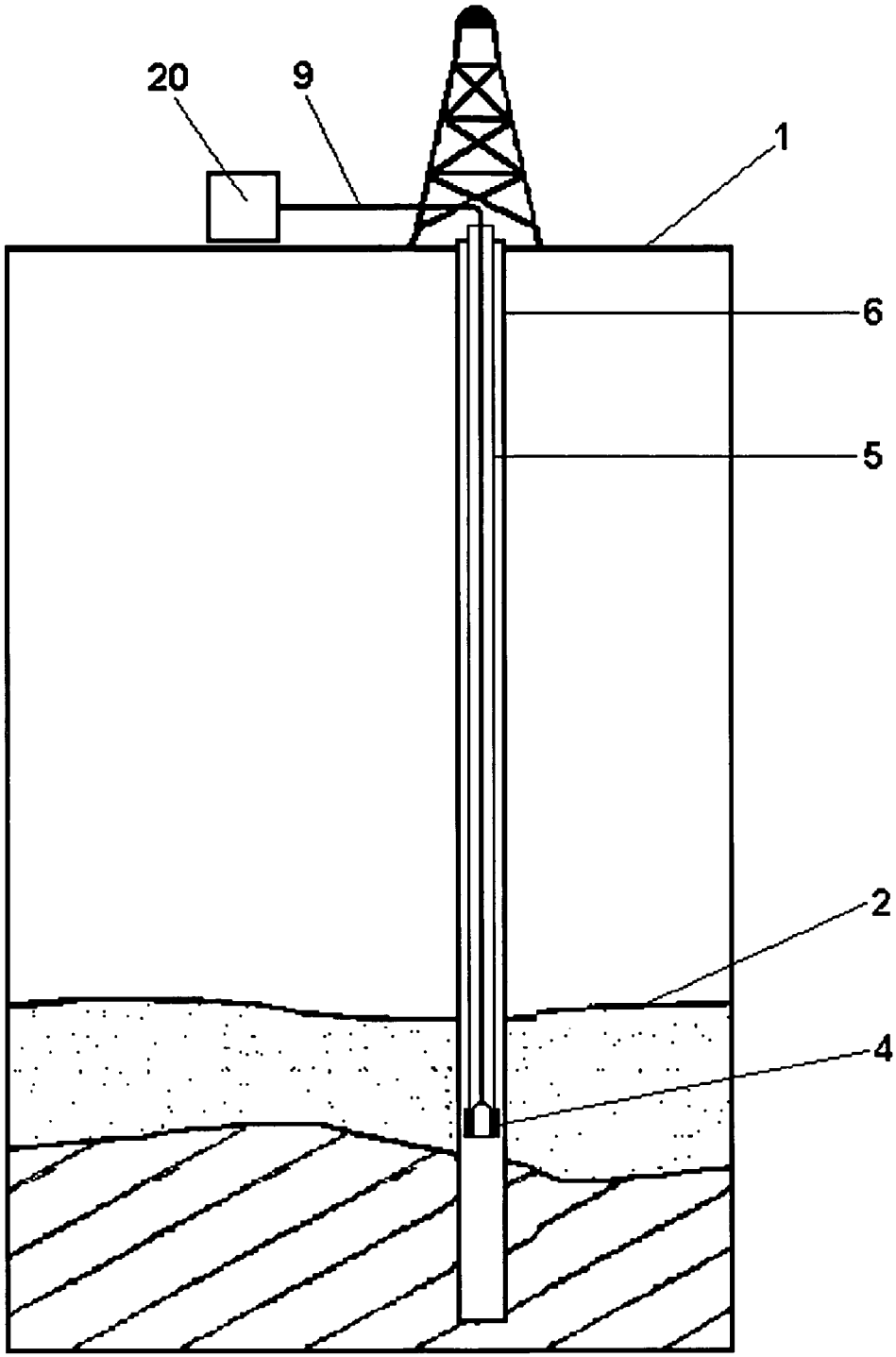
FIG. 1 shows the general structure of the oil well.

FIG. 1 shows the general structure of the oil well and a surface device 20 at daylight level 1 (which contains the surface ultrasonic generator 3 and the daylight surface high frequency generator 10) and the ultrasonic magnetostrictive radiator 4 at the end of the oil well tubing 5, connected by the three-cord electrical cable 9.

Figure 2:
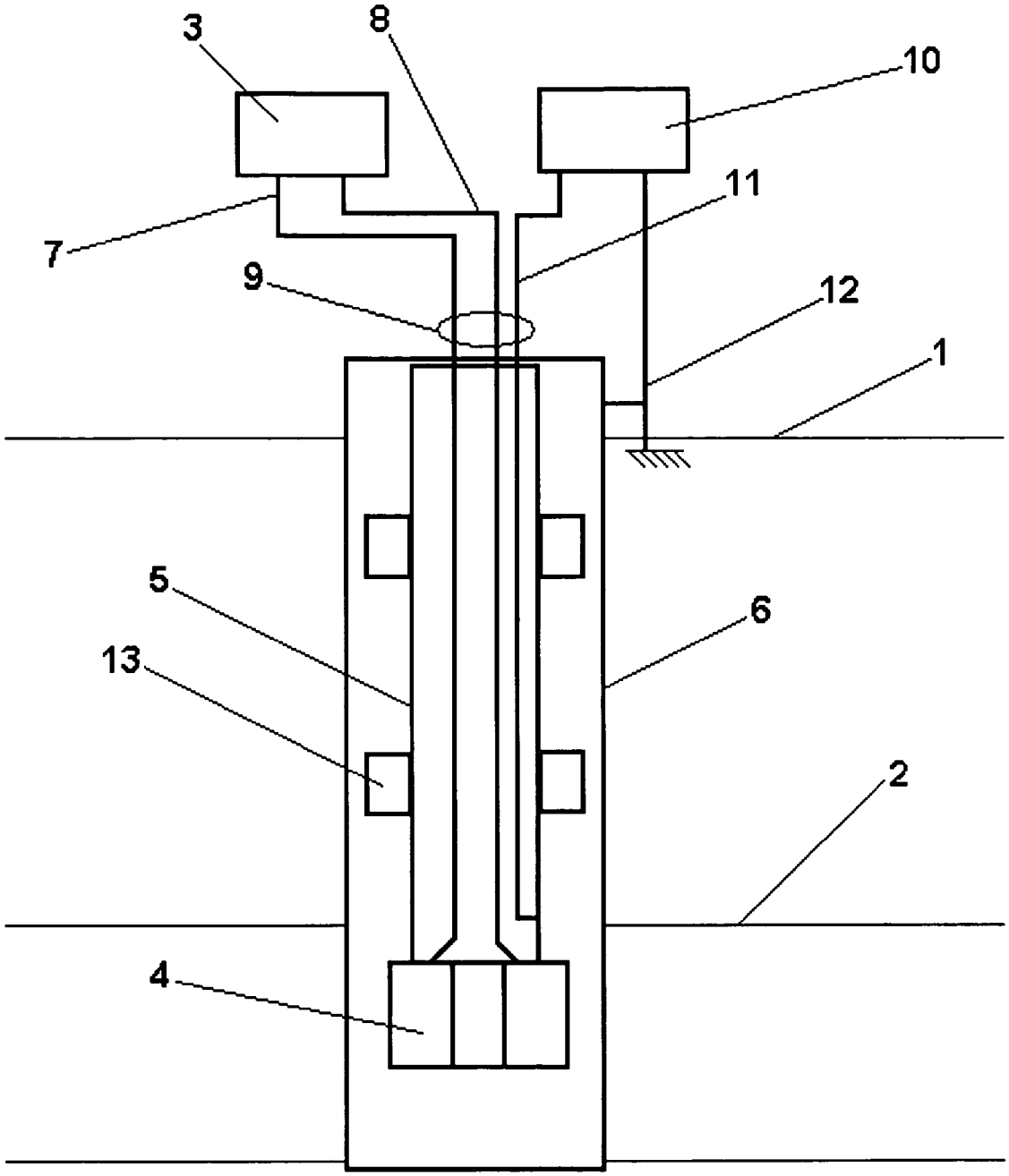
FIG. 2 shows an apparatus for the implementation of the method for intensification of production of high-viscosity oils.

The following is shown in FIG. 2: the daylight level 1, stratum-reservoir 2, the unit of ultrasonic excitation of the well bottom zone which includes the surface ultrasonic generator 3 and at least one ultrasonic magnetostrictive radiator 4 placed at the end of OWT 5.

The ultrasonic magnetostrictive radiator 4 is made in the form of a hollow cylinder, whose inside diameter matches the inside diameter of OWT 5.

The surface ultrasonic generator 3 and the ultrasonic magnetostrictive radiator 4 are electrically connected to each other by two cords 7 and 8 of the three-cord electrical cable 9.

The OWT heating unit consists of the surface high-frequency generator 10 and the OWT heating unit line, which is distributed along the entire length of OWT 5, heated by high-frequency currents, including the third cord 11 of the three-cord electrical cable 9.

In one of the cases of the invention implementation (FIG. 2), in the the heating line of OWT 5 by high-frequency currents one output of the surface high-frequency generator 10 on the daylight surface 1 is electrically connected to OWT 5 by a grounded wire 12. The other output of the surface high-frequency generator 10 is connected directly to OWT 5 by the third cord 11 of the cable 9 in the well bottom zone at the place of the location of the ultrasonic magnetostrictive radiator 4. OWT 5 is electrically insulated from the well casing pipe 6 with the use of insulators 13.

Figure 3:
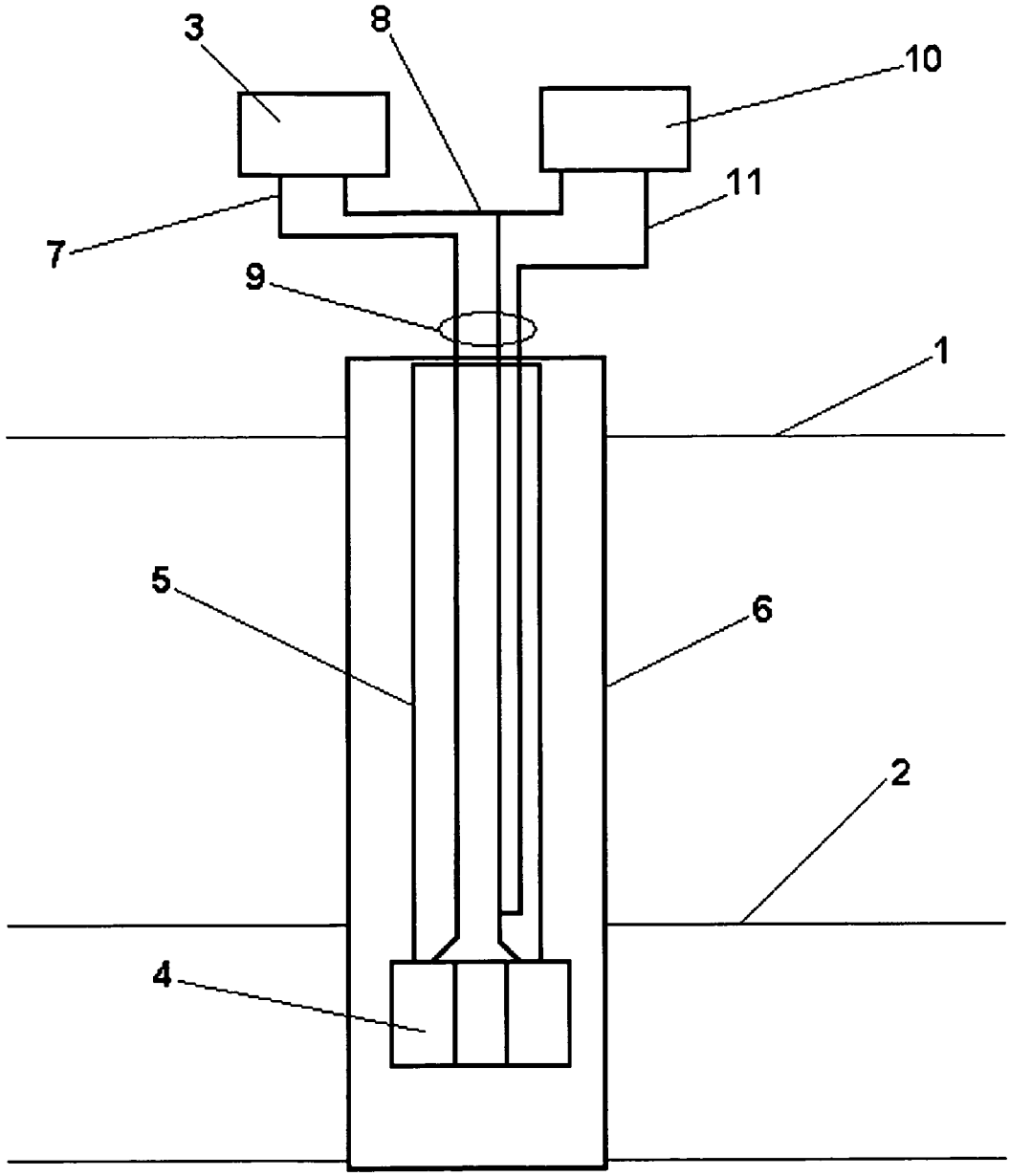
FIG. 3 shows an apparatus for the implementation of the method for intensification 15 of production of high-viscosity oils using common cord.
Figure 4:
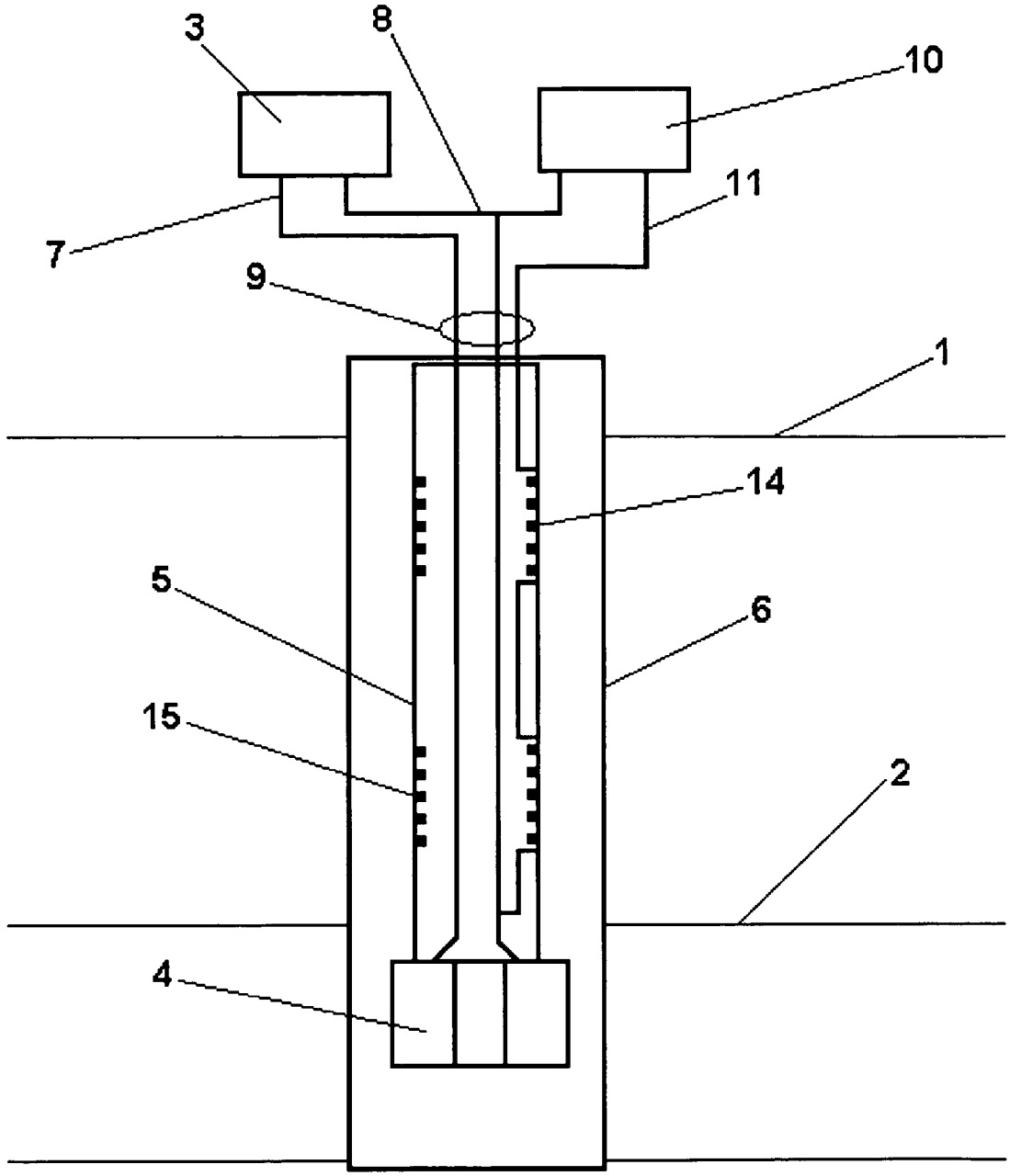
FIG. 4 shows an apparatus for the implementation of the method for intensification of production of high-viscosity oils using common cord and inductors.

In the other particular case shown in FIG. 3, in the heating line of OWT 5 by high-frequency currents, one output of the surface high-frequency generator 10 is connected on the daylight surface 1 to one of the outputs of the surface ultrasonic generator 3, and the cord 8 of the three-cord cable 9 which is connected to this output is a common cord for both generators 3 and 10. At that, the second output of the surface high-frequency generator 10 is connected by the third cord 11 of the cable 9 to the common cord 8 of the cable 9 in the well bottom zone at the place of the location of the ultrasonic magnetostrictive radiator 4.

The line of the OWT heating by high-frequency currents for more intensive heating of OWT 5 and consequently for facilitation of oil transportation can in addition contain at least two inductors 14 and 15 (FIG. 4) placed on OWT 5 and connected to the third cord 11 of the cable 9.

An example of the method implementation is as follows.

High-power ultrasonic vibrations from the surface ultrasonic generator 3 are transmitted through cords 7 and 8 of the three-cord cable 9 to the ultrasonic magnetostrictive radiator 4. The power of ultrasonic vibrations induced by the surface ultrasonic generator 3 depends on the viscosity and amount of oil being produced. By adjusting the power of ultrasonic vibrations, the optimization of the process of oil production is achieved.

Depending on the increase in the thickness of a stratum and the viscosity and amount of oil being produced, the number of ultrasonic radiators varies from 1 to more, changing towards an increase. At the stratum thickness of more than 20 m, permeability lower than 20 millidarcy, porosity less than 20%, yield 15–20 tonne/day and viscosity about 50 centipoise, it is necessary to install at least 2 high-power radiators.

Under the excitation of an ultrasonic field by magnetostrictive radiators, the following occurs:

- Intensification of the processes of heat and mass transfer in the well bottom zone in an ultrasonic field,
- Decrease of oil viscosity of oil in the ultrasonic field (by about 30% in free space, and to a substantially greater extent in porous media under sonocapillary effect. The extent of decrease in viscosity is determined by the features of medium porosity and the parameters of an ultrasonic field.),
- Heating of the well bottom zone due to the loss of energy in a magnetostrictive radiator, because its efficiency does not exceed 50%, and heat transfer into the well bottom zone,
- Use of a magnetostrictive radiator as an electro-acoustic transducer as a result of a higher Curie point as compared to the use of piezoceramics allows one to substantially increase the operating temperatures for crying out the method.

From the well bottom zone, oil comes into OWT 5. OWT 5 is heated by high-frequency currents in the following way.

Both in the first and in the second case of the connection of the third cord 11 of the cable 9 to OWT 5 directly or via the common cord 8, its induction heating occurs by high-frequency currents.

In the first case (FIG. 2), high-frequency currents from the daylight surface high frequency generator 10 directly via the third cord 11 come into OWT 5 and heat it. But, at that, the insulation of OWT 5 from the casing pipe 6 with the use of insulators 13 is necessary. This method can be used in more unfavorable conditions of oil extraction.

In the second case (FIG. 3), high-frequency currents from the daylight surface high frequency generator 10 via the junction of the third cord 11 and the common cord 8 come into OWT 5 and heat it. In this case the insulation of OWT 5 is not required. This particular case is more easily producible, but then, there is a limitation on the increase in temperature conditions of oil production by the temperature stability of the cable, and in this connection it is advisable for use in less adverse conditions of oil production.

Under the most adverse conditions of oil production, it is appropriate to use the additional heating of OWT 5, which is conducted with the use of inductors 14 and 15.

The oil transported by the tubing heated in this way retains its reduced viscosity aid therefore the efficiency of oil production increases.

In the proposed invention, a rise in the permeability of a reservoir, a reduction in the viscosity of oil and, as a consequence, an increase in the efficiency of oil production, as well as an increase in environmental safety is achieved owing to the following: Decrease in the viscosity of oil in the well bottom zone due to the combined ultrasonic and thermal treatment, Decrease in the viscosity of oil in OWT due to its heating by high-frequency currents.

What is claimed is:

1. An apparatus for intensification of production of high-viscosity oils which contains a unit for ultrasonic excitation of a well bottom zone that consists of a surface ultrasonic generator and at least one ultrasonic magnetostrictive radiator placed at an end of oil-well tubing (OWT), which are electrically connected with each other by two cords of a three-cord electrical cable, and a unit of the for heating of oil well tubing that consists of a surface high-frequency generator and a line for the oil well tubing heating, which is distributed along the entire length of oil well tubing and heats oil well tubing by high-frequency currents, said line including a third cord of the three-cord electrical cable.

2. The apparatus of claim 1, wherein the unit for heating of oil well tubing includes a surface high-frequency generator on a daylight surface, said high frequency generator being electrically connected by a grounded wire to oil well tubing, which is electrically insulated from a casing pipe of a well, and at a location of said ultrasonic magnetostrictive radiator, the surface high-frequency generator is connected to oil well tubing by the third cord of the three-cord electrical cable.

3. An apparatus of claim 2, wherein the ultrasonic magnetostrictive radiator has an inside diameter that matches the oil well tubing inside diameter.

4. An apparatus of claim 3, wherein the ultrasonic magnetostrictive radiator is made in the form of a hollow cylinder or similar shape.

5. An apparatus of claim 1, wherein the oil well tubing heating unit includes one output of the surface high-frequency generator connected on a daylight surface to a first one output of the surface ultrasonic generator and one cord of the three-cord electrical cable which is connected to this first output is a common cord for both generators, and a second output of the surface high-frequency generator is connected by the third cord of the three-cord electrical cable at of the location of the ultrasonic magnetostrictive radiator, to said common cord of said three-cord electrical cable.

6. An apparatus of claim 5, wherein said line for oil well tubing heating, by high-frequency currents, further contains at least two inductors placed on oil well tubing and connected to said third cord of the three-cord electrical cable.

7. An apparatus of claim 6, wherein the ultrasonic magnetostrictive radiator has an inside diameter that matches an oil well tubing inside diameter.

8. An apparatus of claim 7, wherein the ultrasonic magnetostrictive radiator is made in the form of a hollow cylinder or similar shape.

9. A method for intensification of production of high-viscosity oils, in which the viscosity of oil in a well bottom zone is decreased by applying of a high-power ultrasonic field on said well bottom zone and in addition, providing heating of the well bottom zone, and maintaining the achieved decreased viscosity of oil during its transportation to the daylight surface through the heating of oil-well tubing (OWT) by high-frequency currents.

10. The method of claim 9 wherein heating said oil well tubing comprises:

distributing a line along the length of said oil well tubing and providing said high-frequency currents through said line.

11. The method of claim 10 further comprising:

providing a high-frequency generator on a daylight surface;

electrically coupling said high frequency generator by a grounded wire to said oil well tubing, which is electrically insulated from a casing pipe of a well; and electrically coupling said high-frequency generator to said oil well tubing by a cord of an electrical cable at a location adjacent to an ultrasonic radiator.

12. The method of claim 10 further comprising:

providing a high-frequency generator and an ultrasonic generator on a daylight surface;

coupling a first cord of a three-cord cable to said ultrasonic generator and said high-frequency generator at said surface and to an ultrasonic radiator in a well;

coupling said line to said high-frequency generator at said surface and to said first cord at a location adjacent to said ultrasonic radiator, wherein said line comprises a second cord of said three-cord cable; and coupling a third cord of said three-cord cable to said ultrasonic generator at said surface and said ultrasonic radiator in said well.

13. The method of claim 10 further comprising coupling at least two inductors on said oil well tubing to said line.

* * * * *